US011629902B2

(12) United States Patent
Miller et al.

(10) Patent No.: US 11,629,902 B2
(45) Date of Patent: Apr. 18, 2023

(54) REFRIGERATOR APPLIANCE HAVING AN ICE STORAGE BIN

(71) Applicant: Haier US Appliance Solutions, Inc., Wilmington, DE (US)

(72) Inventors: Charles Benjamin Miller, Louisville, KY (US); Lauren Nicole Platts, Louisville, KY (US); Louis A. Wantland, Louisville, KY (US); Jarvis Ward, Louisville, KY (US); Bradley Nicholas Gilkey, Louisville, KY (US); Michael C. Watanabe, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 113 days.

(21) Appl. No.: 16/417,709

(22) Filed: May 21, 2019

(65) Prior Publication Data

US 2020/0370813 A1 Nov. 26, 2020

(51) Int. Cl.

| | |
|---|---|
| ***F25C 5/20*** | (2018.01) |
| ***F25C 5/182*** | (2018.01) |
| ***F25C 5/187*** | (2018.01) |

(52) U.S. Cl.

CPC ..... *F25C 5/22* (2018.01); *F25C 5/182* (2013.01); *F25C 5/187* (2013.01); *F25C 2400/10* (2013.01); *F25C 2400/14* (2013.01); *F25C 2600/02* (2013.01); *F25C 2600/04* (2013.01); *F25C 2700/02* (2013.01)

(58) Field of Classification Search

CPC .. F25C 5/22; F25C 5/182; F25C 5/187; F25C 2600/02; F25C 2600/04; F25C 2700/02

See application file for complete search history.

(56) References Cited

U.S. PATENT DOCUMENTS

| | | | | |
|---|---|---|---|---|
| 2,899,804 | A * | 8/1959 | Carew | F25C 5/185 62/344 |
| 3,621,668 | A * | 11/1971 | Swerbinsky | F25C 5/22 62/344 |
| 8,312,735 | B2 | 11/2012 | Fulton | |
| 8,745,992 | B2 | 6/2014 | Cheong et al. | |
| 2001/0025505 | A1* | 10/2001 | Nelson | F25C 5/22 62/371 |
| 2009/0229284 | A1 | 9/2009 | Fulton | |
| 2009/0293510 | A1* | 12/2009 | Kim | F25C 5/187 62/73 |

(Continued)

*Primary Examiner* — Tavia Sullens

(74) *Attorney, Agent, or Firm* — Dority & Manning, P.A.

(57) ABSTRACT

A refrigerator appliance, as disclosed herein, may include a cabinet, a door, a dispensing assembly, an ice-making assembly, and an ice storage bin. The door may define a dispenser recess having a transverse opening extending vertically from a top recess end to a bottom recess end and laterally from a first recess side to a second recess side. The dispensing assembly may be positioned within the dispenser recess and define an ice delivery passage. The ice-making assembly may be attached to the cabinet. The ice storage bin may include a bin body defining a storage cavity. The bin body may be selectively mounted to the door within the dispenser recess to receive ice from the dispensing assembly. The bin body may extend vertically from the top recess end to the bottom recess end and laterally from the first recess side to the second recess side.

20 Claims, 11 Drawing Sheets

(56) References Cited

U.S. PATENT DOCUMENTS

| | | | | |
|---|---|---|---|---|
| 2012/0111041 | A1* | 5/2012 | Mitchell | F25C 5/22 62/137 |
| 2016/0025399 | A1 | 1/2016 | Miller et al. | |
| 2016/0201967 | A1* | 7/2016 | Mitchell | F25C 5/22 62/135 |
| 2018/0209718 | A1* | 7/2018 | Staud | F25C 5/20 |
| 2018/0363966 | A1 | 12/2018 | Hottenroth et al. | |

* cited by examiner

REFRIGERATOR APPLIANCE HAVING AN ICE STORAGE BIN

FIELD OF THE INVENTION

The present subject matter relates generally to refrigerator appliances, and more particularly to refrigerator appliances having a selectively accessible ice storage bin.

BACKGROUND OF THE INVENTION

Refrigerator appliances generally include a cabinet that defines one or more chilled chambers for receipt of food articles for storage. In addition, refrigerator appliances also generally include a door rotatably hinged to the cabinet to permit selective access to food items stored in chilled chamber(s). Certain refrigerator appliances include an icemaker. In order to produce ice, liquid water is directed to the icemaker and frozen. After being frozen, ice may be directed to a separate ice storage bin. In order to maintain ice in a frozen state, the ice storage bin may be positioned within one of the chilled chambers or a separate compartment behind one of the doors.

Although the ice storage bin of a refrigerator appliance may be accessible to a user, such access generally requires opening a door to the chilled chamber. Thus, if a user wishes to draw ice directly from the ice storage bin, relatively hot ambient air will be introduced to the chilled chamber. The introduction of ambient air may greatly increase the temperature within the chilled chamber and reduce the overall efficiency of the refrigerator appliance. Some systems may provide a dispenser assembly in the door to direct ice from the icemaker or ice storage bin to an area outside of the refrigerator appliance. However, such a dispenser assembly generally only provides a limited area from which ice may be dispensed.

Similar, if not greater concerns, may arise if a user simply wishes to view the contents of the ice storage bin (e.g., to see how much ice is currently stored within the ice storage bin). A user is generally required to open the door of the refrigerator appliance to view of the ice storage bin. Moreover, since the contents of many ice storage bins are not readily visible, even when door to chilled chamber is open, a user may be required to completely or partially remove the ice storage bin in order to view its contents.

Accordingly, it would be advantageous to provide a refrigerator appliance with feature(s) addressing one or more of the above-identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a door, a dispensing assembly, an ice-making assembly, and an ice storage bin. The cabinet may define a chilled chamber. The door may define a dispenser recess having a transverse opening extending vertically from a top recess end to a bottom recess end and laterally from a first recess side to a second recess side, the door being rotatably hinged to the cabinet to rotate between a closed position restricting access to the chilled chamber and an open position permitting access to the chilled chamber. The dispensing assembly may be positioned within the dispenser recess and define an ice delivery passage. The ice-making assembly may be attached to the cabinet. The ice storage bin may include a bin body defining a storage cavity. The bin body may be selectively mounted to the door within the dispenser recess to receive ice from the dispensing assembly. The bin body may extend vertically from the top recess end to the bottom recess end and laterally from the first recess side to the second recess side.

In another exemplary aspect of the present disclosure, a refrigerator appliance is provided. The refrigerator appliance may include a cabinet, a door, a dispensing assembly, an ice-making assembly, and an ice storage bin. The cabinet may define a chilled chamber. The door may define a dispenser recess having a transverse opening extending vertically from a top recess end to a bottom recess end and laterally from a first recess side to a second recess side, the door being rotatably hinged to the cabinet to rotate between a closed position restricting access to the chilled chamber and an open position permitting access to the chilled chamber. The dispensing assembly may be positioned within the dispenser recess and define an ice delivery passage and a water delivery passage. The water delivery passage may be directed toward the dispenser recess. The ice-making assembly may be attached to the cabinet. The ice storage bin may include a transparent bin body defining a storage cavity rearward from the water delivery passage along the transverse direction. The bin body may be selectively mounted to the door within the dispenser recess to receive ice from the dispensing assembly. The bin body may extend vertically from the top recess end to the bottom recess end and laterally from the first recess side to the second recess side.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
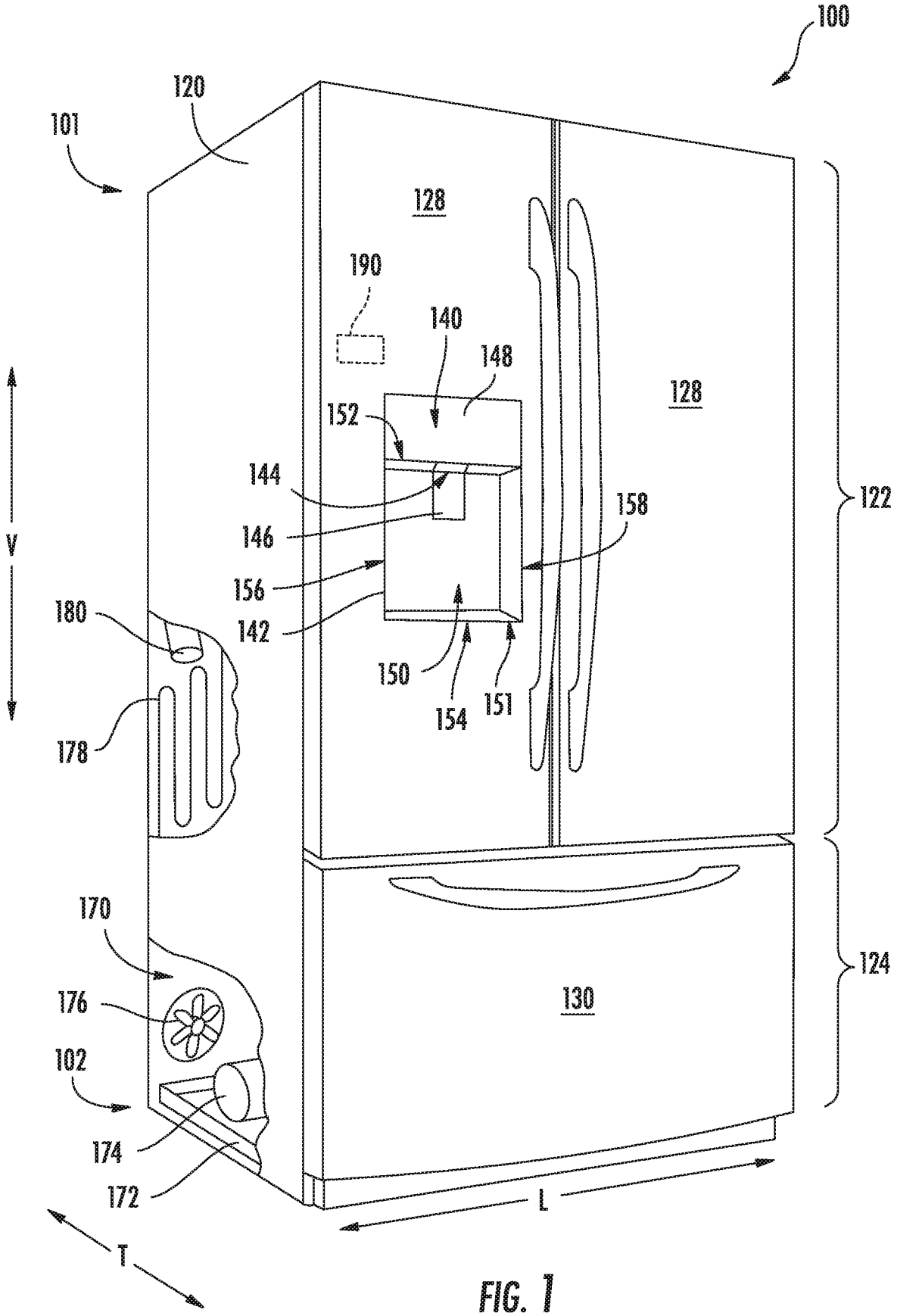
FIG. 1 provides a perspective view of a refrigerator appliance according to exemplary embodiments of the present disclosure, wherein refrigerator doors are shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
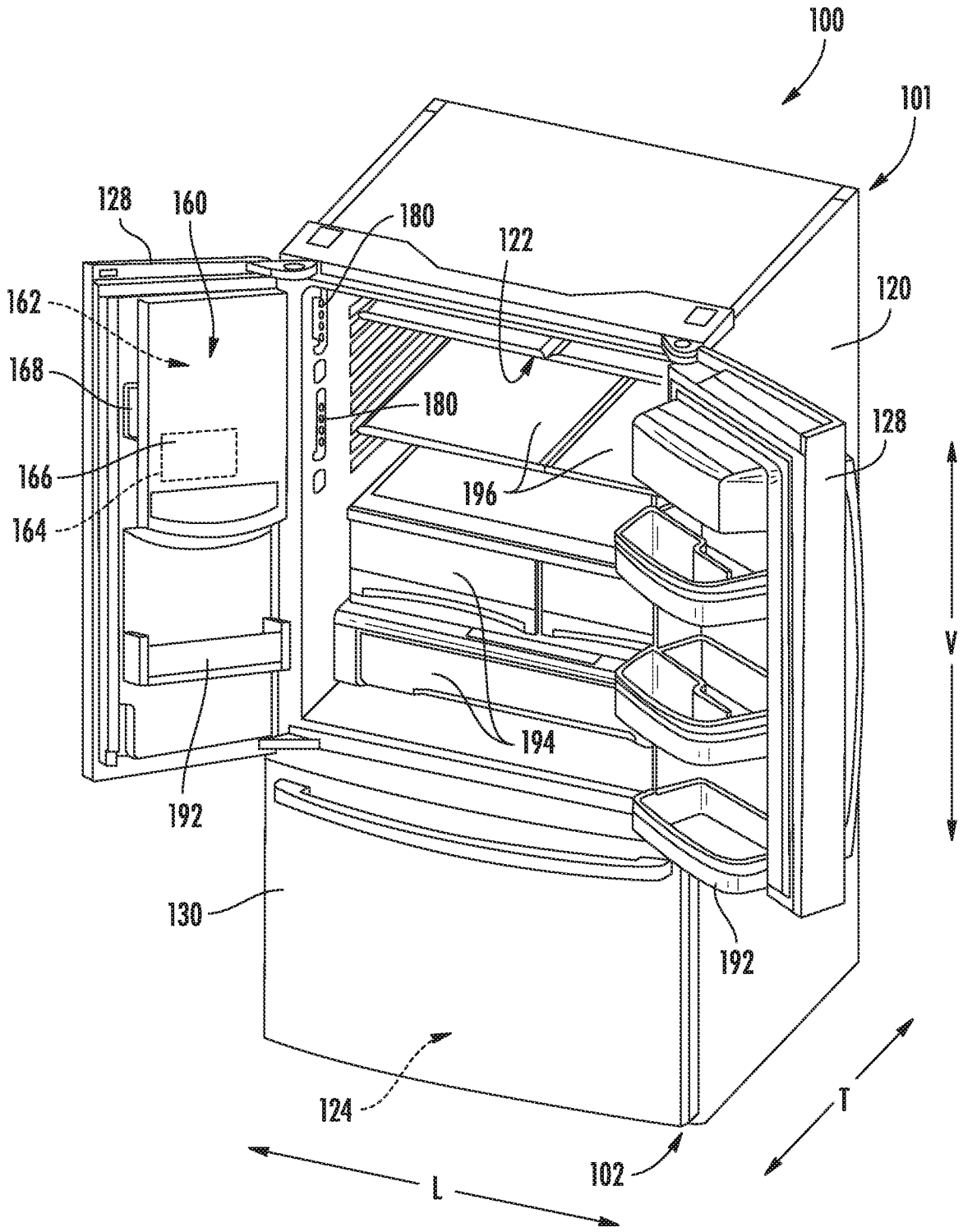
FIG. 2 provides a perspective view of the example refrigerator appliance of FIG. 1, wherein refrigerator doors are shown in an open position to reveal a fresh food chamber.

Referring now to the drawings, FIGS. 1 and 2 provide perspective views of a refrigerator appliance 100 according to example embodiments of the present disclosure. Generally, FIG. 1 provides a pair of refrigerator doors 128 in a closed position, while FIG. 2 provides refrigerator doors 128 in an open position.

Refrigerator appliance 100 includes a cabinet or housing 120 that extends between a top 101 and a bottom 102 along a vertical direction V. Cabinet 120 also extends along a lateral direction L and a transverse direction T, each of the vertical direction V, lateral direction L, and transverse direction T being mutually perpendicular to one another. Cabinet 120 defines one or more chilled chambers for receipt of food items for storage. In some embodiments, cabinet 120 defines a fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

In exemplary embodiments, various storage components are mounted within fresh food chamber 122 to facilitate storage of food items therein, as will be understood by those skilled in the art. In particular, the storage components may include storage bins 192, drawers 194, and shelves 196 that are mounted within fresh food chamber 122. Storage bins 192, drawers 194, and shelves 196 are configured for receipt of food items (e.g., beverages or solid food items) and may assist with organizing such food items. As an example, drawers 194 can receive fresh food items (e.g., vegetables, fruits, or cheeses) and increase the useful life of such fresh food items.

Refrigerator doors 128 are rotatably hinged to an edge of cabinet 120 for selectively accessing fresh food chamber 122. In some embodiments, a freezer door 130 is arranged below refrigerator doors 128 for selectively accessing freezer chamber 124. Freezer door 130 may coupled to a freezer drawer (not shown) slidably mounted within freezer chamber 124. Refrigerator doors 128 and freezer door 130 are shown in the closed configuration in FIG. 1.

In some embodiments, refrigerator appliance 100 includes a dispensing assembly 140 for dispensing liquid water or ice. Dispensing assembly 140 includes a dispenser 142 positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, another suitable actuator may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150, as will be described in greater detail below. Generally, dispenser recess 150 defines a transverse opening 151 that extends in the vertical direction V from a top recess end 152 to a bottom recess end 154, as well as in the lateral direction L from a first recess side 156 to a second recess side 158. In certain embodiments, dispenser recess 150 is positioned at a predetermined elevation convenient for a user to access ice or water and enabling the user to access ice without the need to bend-over and without the need to open doors 128. In optional embodiments, dispenser recess 150 is positioned at a level that approximates the chest level of a user.

In some embodiments, refrigerator appliance 100 includes a sub-compartment 162 defined on refrigerator door 128. Sub-compartment 162 is often referred to as an "icebox." Moreover, sub-compartment 162 extends into fresh food chamber 122 when refrigerator door 128 is in the closed position.

As shown, an ice-making assembly 160 is attached to cabinet 120 (e.g., indirectly attached to cabinet 120 via door 128—as shown—or, alternatively, directly attached to cabinet 120). In some embodiments, ice-making assembly is positioned or disposed within sub-compartment 162. In optional embodiments, an ice storage bin 164 is further positioned or disposed within sub-compartment 162. Thus, ice is supplied to dispenser recess 150 from ice-making assembly 160 or ice storage bin 164 in sub-compartment 162 on a back side of refrigerator door 128. Chilled air from a sealed system of refrigerator appliance 100 may be directed into ice-making assembly 160 in order to cool components of ice-making assembly 160. In particular, an evaporator 178 (e.g., positioned at or within fresh food chamber 122 or freezer chamber 124) is configured for generating cooled or chilled air. A supply conduit 180 (e.g., defined by or positioned within housing 120) extends between evaporator 178 and components of ice-making assembly 160 in order to cool components of ice-making assembly 160 and assist ice formation by ice-making assembly 160.

In some embodiments, during operation of ice-making assembly 160, chilled air from the sealed system cools components of ice-making assembly 160 to or below a freezing temperature of liquid water. Thus, ice-making assembly 160 may be an air cooled ice-making assembly. Chilled air from the sealed system may also cool ice storage bin 164. In particular, air around ice storage bin 164 can be chilled to a temperature above the freezing temperature of liquid water (e.g., to about the temperature of fresh food chamber 122) such that ice cubes in ice storage bin 164 melt over time due to being exposed to air having a temperature above the freezing temperature of liquid water. In addition, ice-making assembly 160 may also be exposed to air having a temperature above the freezing temperature of liquid water. As an example, air from fresh food chamber 122 can be directed into sub-compartment 162 such that ice-making assembly 160 or ice storage bin 164 is exposed to air from fresh food chamber 122.

In optional embodiments, liquid water generated during melting of ice cubes in ice storage bin 164, is directed out of ice storage bin 164. For example, turning back to FIG. 1, liquid water from melted ice cubes may be directed to an evaporation pan 172. Evaporation pan 172 is positioned within a mechanical compartment 170 defined by housing 120 (e.g., at bottom portion 102 of housing 120). A condenser 174 of the sealed system can be positioned, for example, directly, above and adjacent evaporation pan 172. Heat from condenser 174 can assist with evaporation of liquid water in evaporation pan 172. A fan 176 configured for cooling condenser 174 can also direct a flow air across or into evaporation pan 172. Thus, fan 176 can be positioned above and adjacent evaporation pan 172. Evaporation pan 172 may be sized and shaped for facilitating evaporation of liquid water therein. For example, evaporation pan 172 may be open topped and extend across about a width or a depth of housing 120.

In some embodiments, an access door 166 is hinged to refrigerator door 128. Generally, access door 166 may permit selective access to sub-compartment 162. Any manner of suitable latch 168 may further be configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162.

Generally, operation of the refrigerator appliance 100 can be regulated by a controller 190 that is operatively coupled to user interface panel 148 or various other components, as will be described below. User interface panel 148 provides selections for user manipulation of the operation of refrigerator appliance 100, such as selections between whole or crushed ice, chilled water, or other various options. In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry—such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiment, controller 190 is located adjacent to or on user interface panel 148. In other embodiments, controller 190 may be positioned at another suitable location within refrigerator appliance 100, such as for example within a fresh food chamber, a freezer door, etc. Input/output ("I/O") signals may be routed between controller 190 and various operational components of refrigerator appliance 100. For example, user interface panel 148 may be in operable communication (e.g., electrical communication) with controller 190 via one or more signal lines or shared communication busses.

Controller 190 may be operatively coupled with the various components of dispensing assembly 140 and may control operation of the various components. For example, the various valves, switches, etc. may be actuatable based on commands from controller 190. As discussed, interface panel 148 may additionally be operatively coupled (e.g., via electrical or wireless communication) with controller 190. Thus, the various operations may occur based on user input or automatically through controller 190 instruction.

Turning now generally to FIGS. 3 through 13, various views are provided of exemplary embodiments including a removable ice storage bin 210, which may be removably mounted to or positioned within dispenser recess 150. As shown, removable ice storage bin 210 extends along a vertical direction V, lateral direction L, and transverse direction T. As discussed herein with respect to ice storage bin 210, the vertical direction V, lateral direction L, and transverse direction T correspond the above-described vertical direction V, lateral direction L, and transverse direction T when door 128 is in the closed position and ice storage bin is mounted to or positioned within dispenser recess 150.

Figure 3:
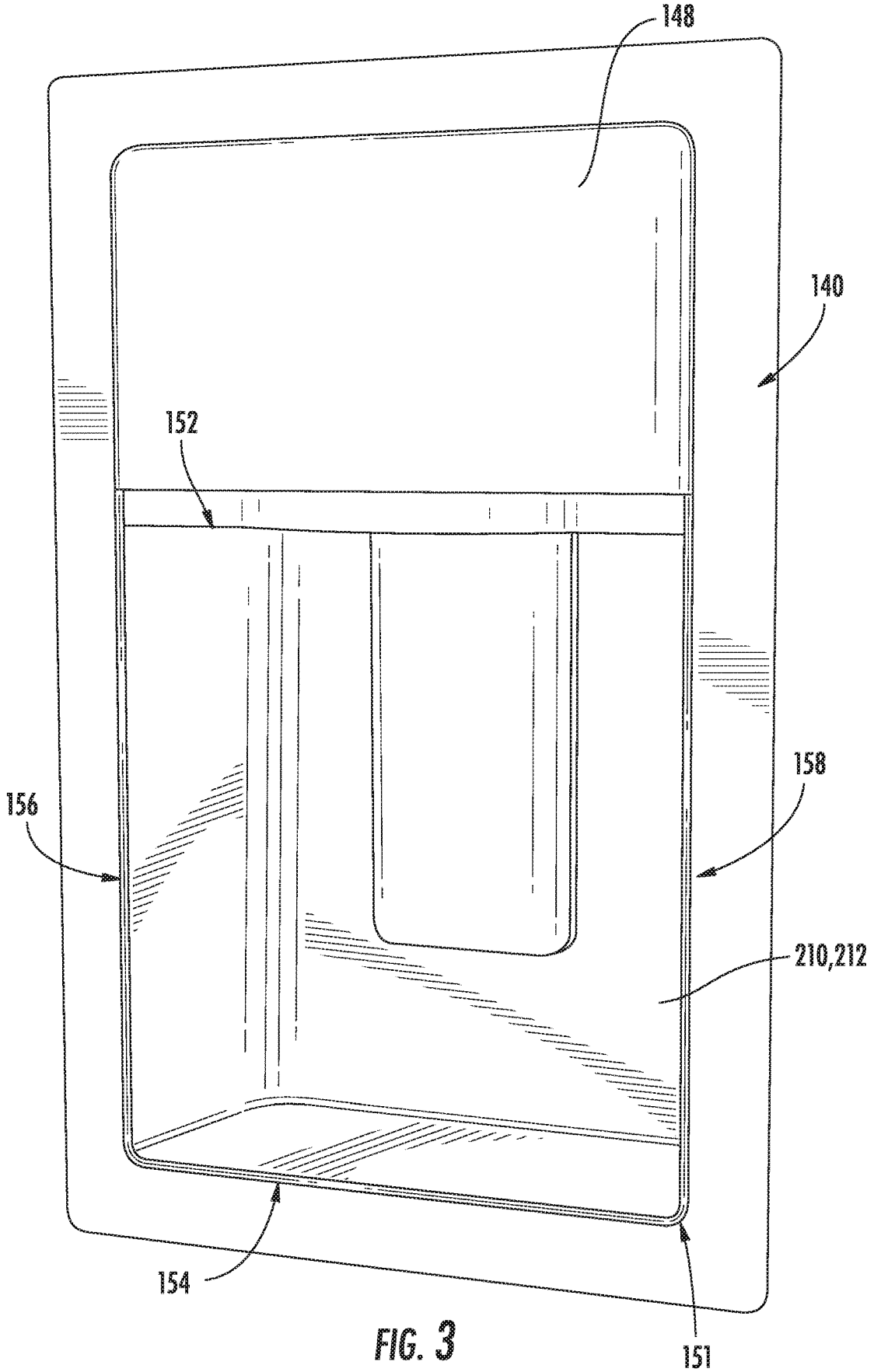
FIG. 3 provides a perspective view of an ice bin and dispensing assembly of a refrigerator appliance according to exemplary embodiments of the present disclosure.

In FIG. 3, a perspective view is provided of a portion dispensing assembly 140. In particular, dispenser recess 150 is illustrated with a removable ice storage bin 210 positioned or disposed therein. Generally, ice storage bin 210 includes a bin body 212 that can be selectively mounted (e.g., to door 128) within dispenser recess 150. As shown, when mounted within dispenser recess 150, bin body 212 may span across most, if not all, of the transverse opening 151 of dispenser recess 150. For instance, bin body 212 may laterally span transverse opening 151, extending laterally from the first recess side 156 to the second recess side 158. Additionally or alternatively, bin body 212 may vertically span transverse opening 151, extending vertically from the top recess end 152 to the bottom recess end 154. Thus, ice storage bin 210 may appear to completely occupy dispenser recess 150 in the lateral direction L or the vertical direction V. In specific embodiments, ice-making assembly 160 and dispensing assembly 140 are mounted above ice storage bin 210 (e.g., when ice storage bin 210 is mounted within dispenser recess 150).

As shown, for instance, in FIGS. 5 through 9, ice storage bin 210 generally includes a plurality of walls defining a storage cavity 224. For instance, ice storage bin 210 may include one or more sidewalls 214, 216 and a base wall 218, which may together define storage cavity 224. Together, the sidewalls 214, 216 define an opening perimeter 220 at a top portion (e.g., vertical extreme opposite base wall 218) of ice storage bin 210. As shown, opening perimeter 220 may permit access to storage cavity 224 (e.g., to add or remove ice 222 therein). In turn, storage cavity 224 may be in communication (e.g., selective physical communication, fluid communication, etc.) with dispensing assembly 140 to receive ice therefrom (e.g., via an ice delivery passage 248—FIG. 10).

In exemplary embodiments, at least one sidewall (e.g., 214 or 216) may be formed from a clear, see-through (i.e., transparent or translucent) material, such as a clear glass or plastic, such that a user can see into storage cavity 224 and thus view ice therein. For instance, at least one sidewall 214 or 216 may include an exterior panel 228 or an interior panel 230 formed from a clear, see-through (i.e., transparent or translucent) material, such as a clear glass or plastic. Thus, in some such embodiments, bin body 212 may be provided as a transparent bin body 212.

Figure 10:
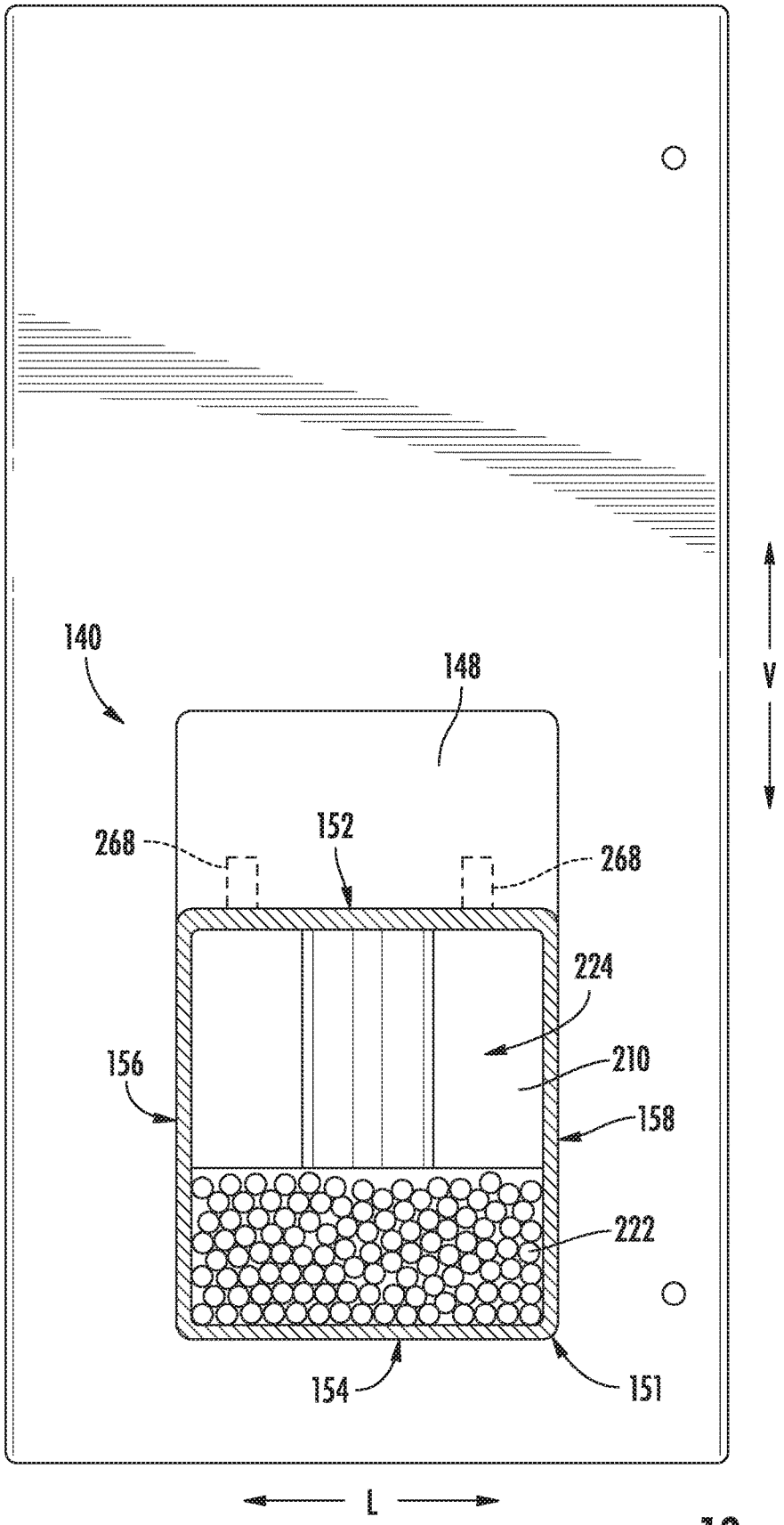
FIG. 10 provides a front plan view of an ice bin and dispensing assembly of a refrigerator appliance according to exemplary embodiments of the present disclosure.

In additional or alternative embodiment, ice storage bin 210 includes at least one insulated sidewall (e.g., 214 or 216). In some such embodiments, when ice storage bin 210 is inserted into the transverse opening 151 or otherwise mounted within dispenser recess 150, an insulated sidewall 214 is positioned across the transverse opening 151 (FIG. 10). As shown, insulated sidewall 214 includes an exterior panel 228 and an interior panel 230. Optionally, one or both of exterior panel 228 or interior panel 230 may extend from base wall 218.

In further additional or alternative embodiments, base wall 218 is formed as an insulated wall (e.g., continuous with insulated sidewall 214). For instance, base wall 218 may include an exterior panel 228 and an interior panel 230. In some such embodiments, base wall 218 is positioned below a portion of insulated sidewall 214 such that base wall 218 is beneath the interior panel 230 along the vertical direction V.

In some embodiments, exterior panel 228 and interior panel 230 are spaced apart, (e.g., in the transverse direction T, the lateral direction L, or the vertical direction V). If horizontally spaced apart, such as in the transverse direction T, a roof segment 232 may span the distance between exterior panel 228 and interior panel 230 at the top portion of ice storage bin 210 (e.g., above a transparent insulation gap 234). As shown, a transparent insulation gap 234 is defined between the panels of the insulated sidewall (e.g., 214 or 216) or base wall 218. For instance, transparent insulation gap 234 may be provided as a sealed volume between exterior panel 228 and interior panel 230. The sealed volume may generally prevent the passage of air or oxygen to or from transparent insulation gap 234. In exemplary embodiments, transparent insulation gap 234 is substantially evacuated as a vacuum. In alternative example embodiments, transparent insulation gap 234 is filled with a set mass of a predetermined gas, such as nitrogen, oxygen, argon, or a suitable inert gas.

Figure 4:
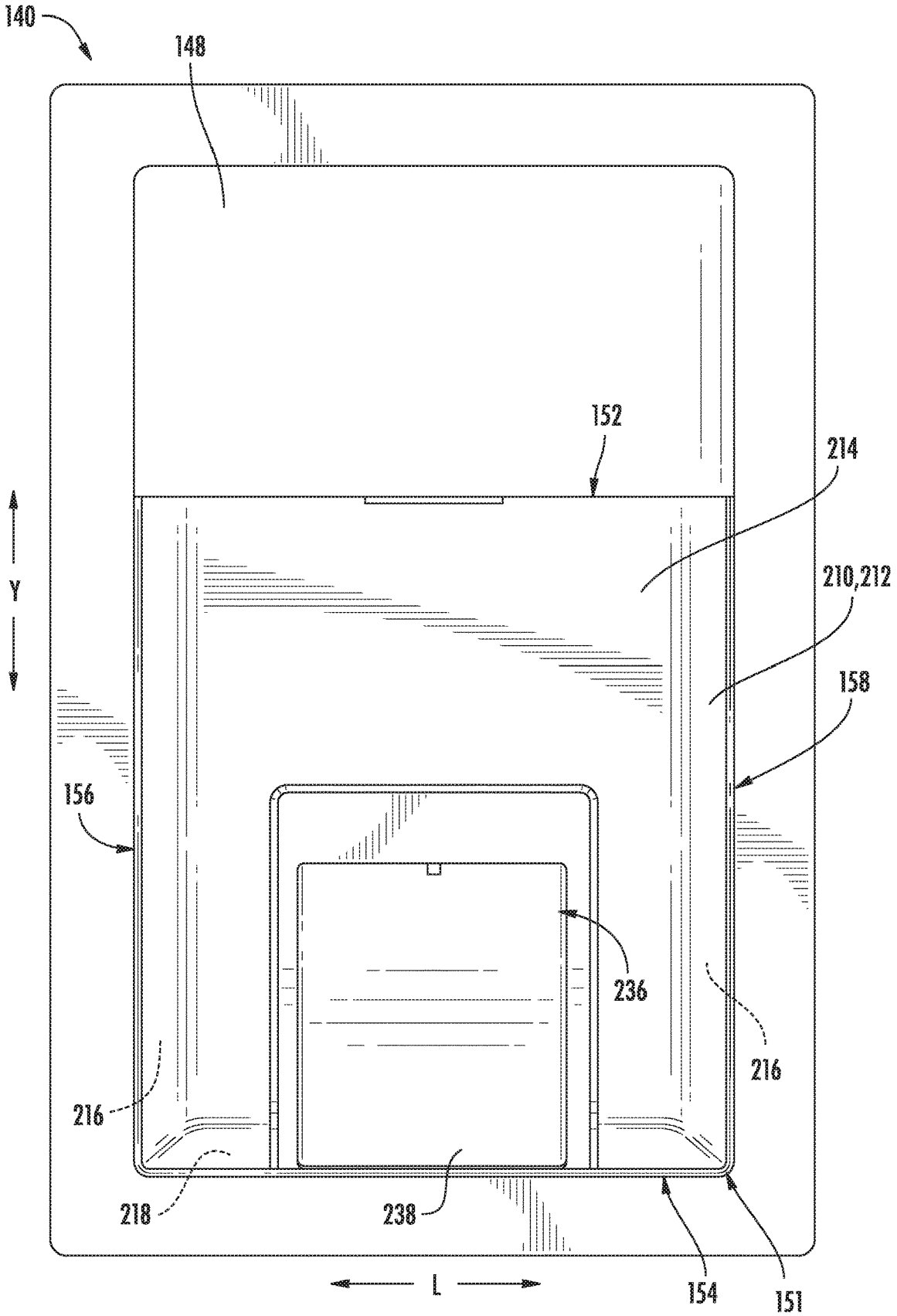
FIG. 4 provides a perspective view of an ice bin and dispensing assembly of a refrigerator appliance according to other exemplary embodiments of the present disclosure.
Figure 5:
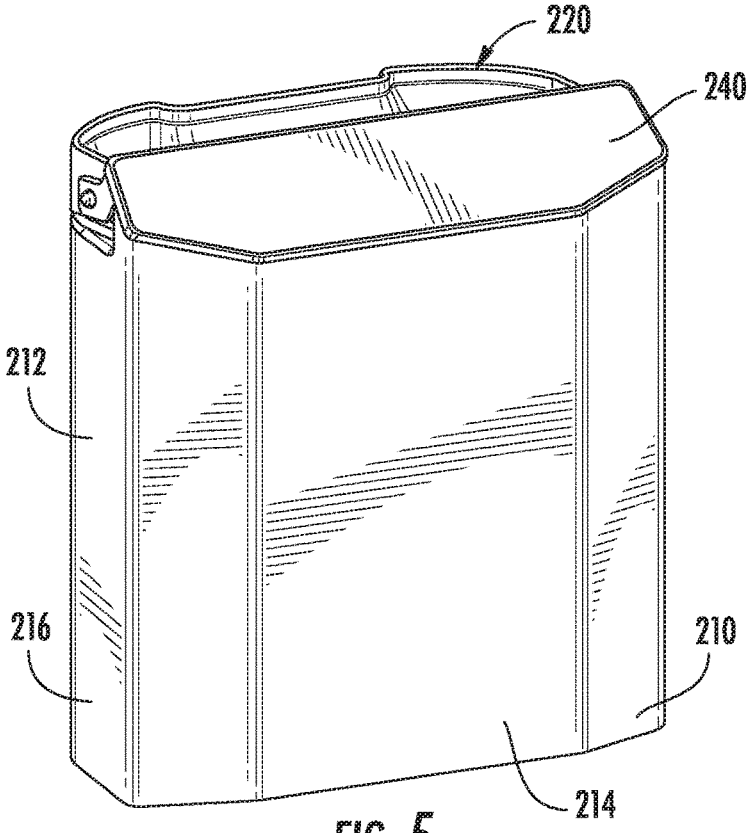
FIG. 5 provides a front perspective view of an isolated ice bin for a refrigerator appliance according to exemplary embodiments of the present disclosure.
Figure 6:
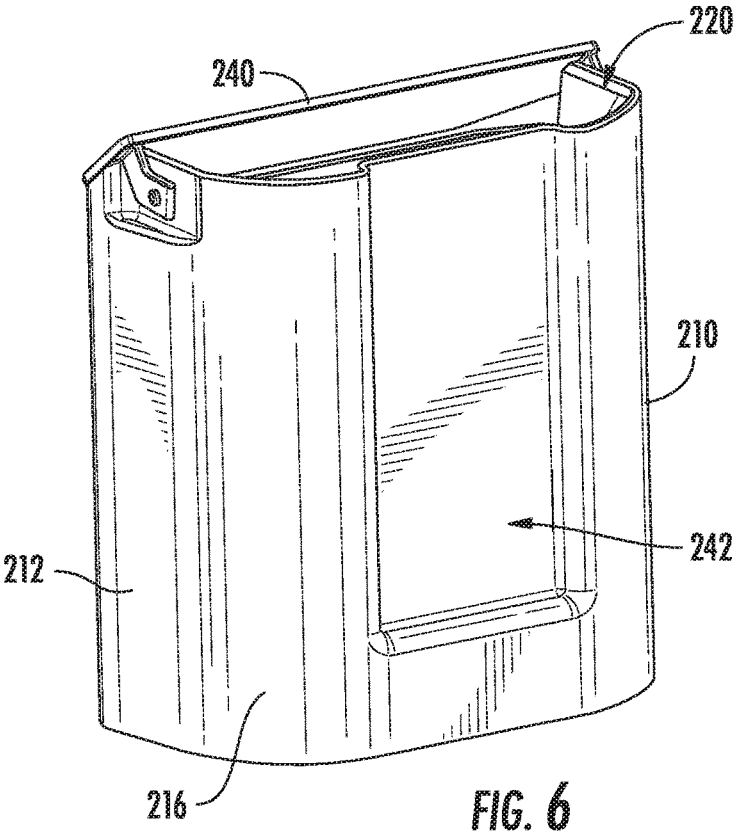
FIG. 6 provides rear perspective view of the exemplary ice bin of FIG. 5.
Figure 7:
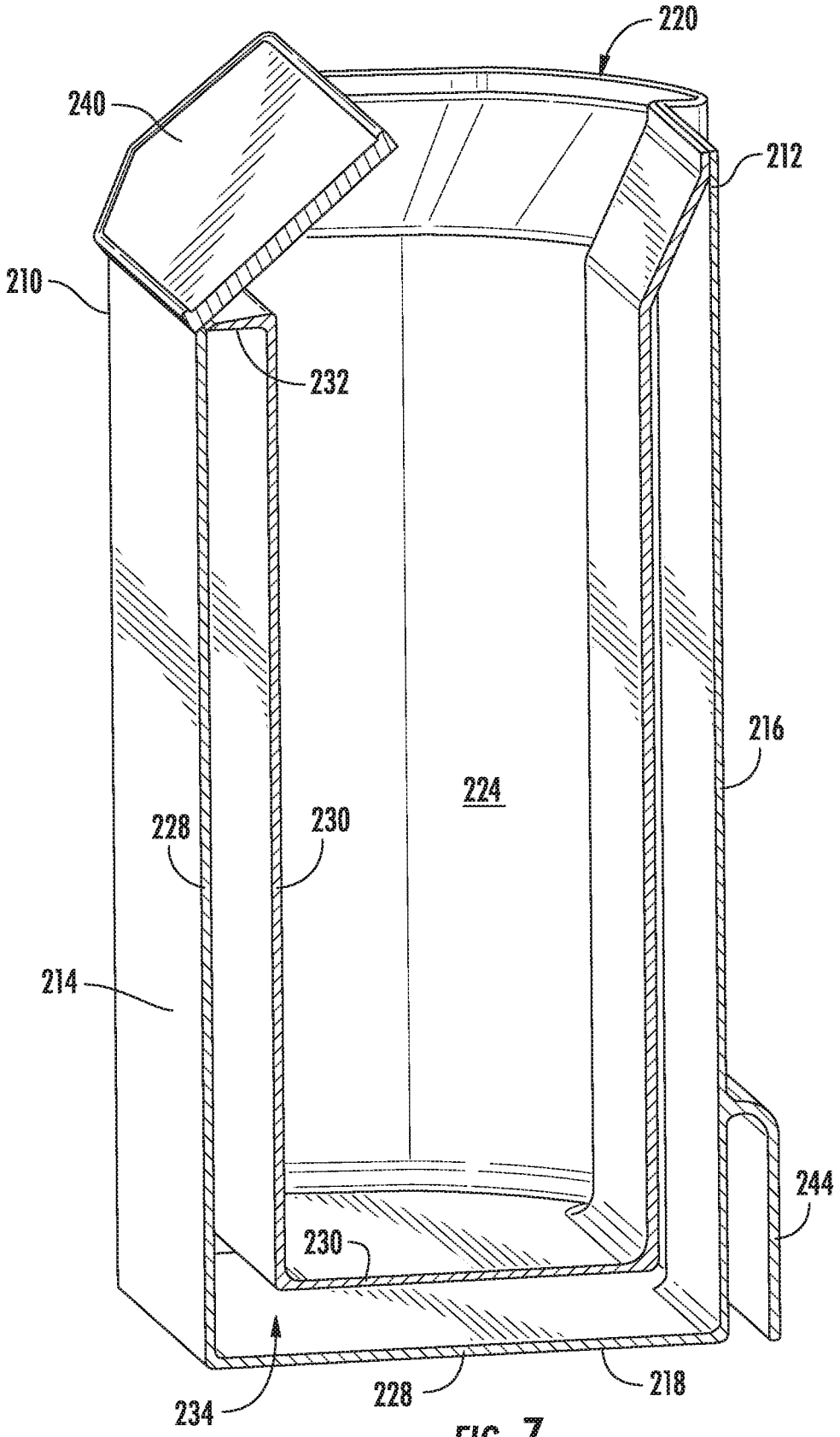
FIG. 7 provides cross-sectional perspective view of the exemplary ice bin of FIG. 5.
Figure 8:
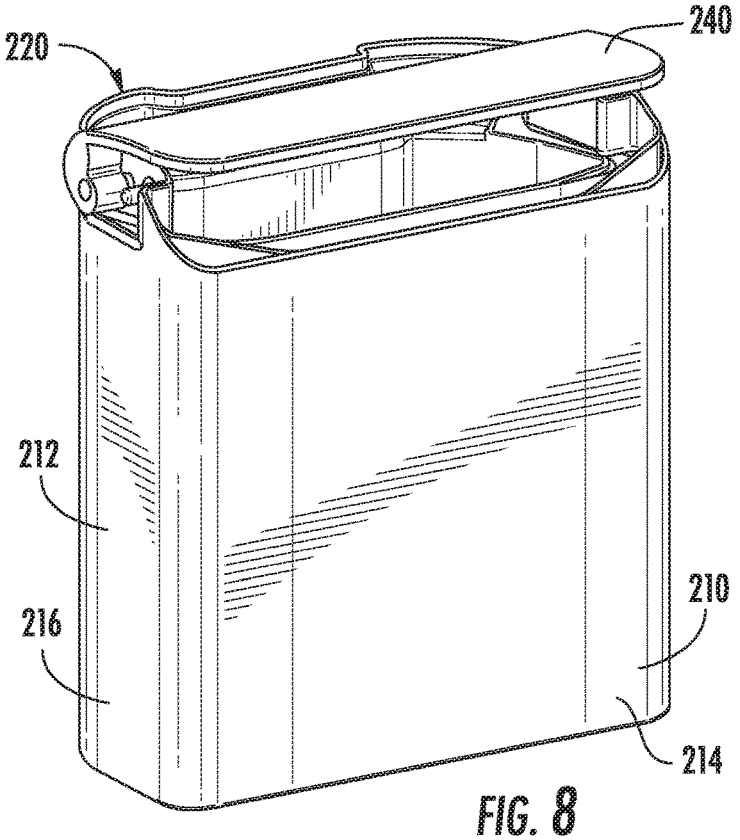
FIG. 8 provides a perspective view of an ice bin and dispensing assembly of a refrigerator appliance according to other exemplary embodiments of the present disclosure.
Figure 9:
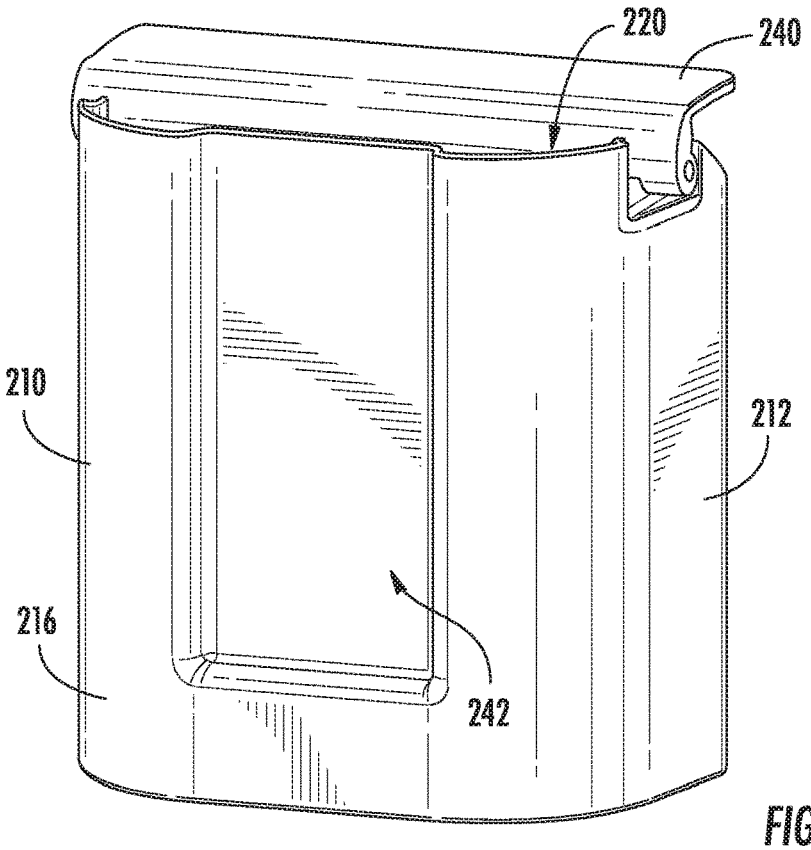
FIG. 9 provides rear perspective view of the exemplary ice bin of FIG. 8.

Turning briefly to FIG. 4, although the sidewalls 214, 216 illustrated in FIGS. 5 through 9 are generally illustrated as solid members through which ice is not permitted, alternative embodiments include at least one sidewall (e.g., front wall 214) that defines a cavity outlet 236 through sidewall 214. Generally, cavity outlet 236 extends in fluid communication between storage cavity 224 and a front face of bin body 212. In some such embodiments, a bin paddle 238 is mounted to the sidewall 214 on or within cavity outlet 236. When assembled, bin paddle 238 may move between a block position that restricts ice from passing through cavity outlet 236 and a release position that permits ice to pass (e.g., along the transverse direction T) through sidewall 214, from cavity outlet 236, and outside of storage bin body 212.

Returning generally to FIGS. 5 through 9, in some embodiments, ice storage bin 210 includes a partial lid 240 attached (e.g., pivotably attached) to bin body 212. For instance, a partial lid 240 may be attached (e.g., pivotably attached) to a top portion of bin body 212 proximate to the opening perimeter 220. Optionally, a partial lid 240 may extend (e.g., along the lateral direction L) along the front sidewall 214. When assembled, partial lid 240 may cover at least a portion of the opening perimeter 220 such that the cross-sectional area (e.g., perpendicular to the vertical direction V) through which ice may be received is reduced (e.g., relative to the overall cross-sectional area defined by the opening perimeter 220). In some such embodiments, partial lid 240 extends generally (e.g., at least in part) upward along the vertical direction V from the opening perimeter 220. Thus, when mounted within dispenser recess 150, partial lid 240 may extend toward the top recess end 152. Optionally, partial lid 240 may engage or contact a portion of dispensing assembly 140 such that air is restricted from passing between an upper surface of ice storage bin 210 and a bottom surface of dispensing assembly 140.

In certain embodiments, at least one sidewall 216 is shaped or otherwise formed to complement a rear wall of the dispenser assembly. For instance, the sidewall 216 may define a curved exterior surface that is the negative shape of the rearmost portion of dispenser recess 150 such that ice storage bin 210 may be transversely aligned and supported thereon. Optionally, the sidewall 216 may define a paddle groove 242 (e.g., as a generally concave surface) to receive the paddle or actuator 146 therein.

In further additional or alternative embodiments, at least one sidewall 216 includes a recess hook 244. As shown, recess hook 244 may extend opposite storage cavity 224 (e.g., from an exterior portion or surface of bin body 212). A corresponding anchor 246 may be formed or defined within dispenser recess 150. Thus, when mounted within dispenser recess 150, recess hook 244 of ice storage bin 210 may selectively engage anchor 246 and secure ice storage bin 210 to dispensing assembly 140 or door 128. Moreover, inadvertent transverse movement of ice storage bin 210 from dispenser recess 150 may be prevented.

Figure 11:
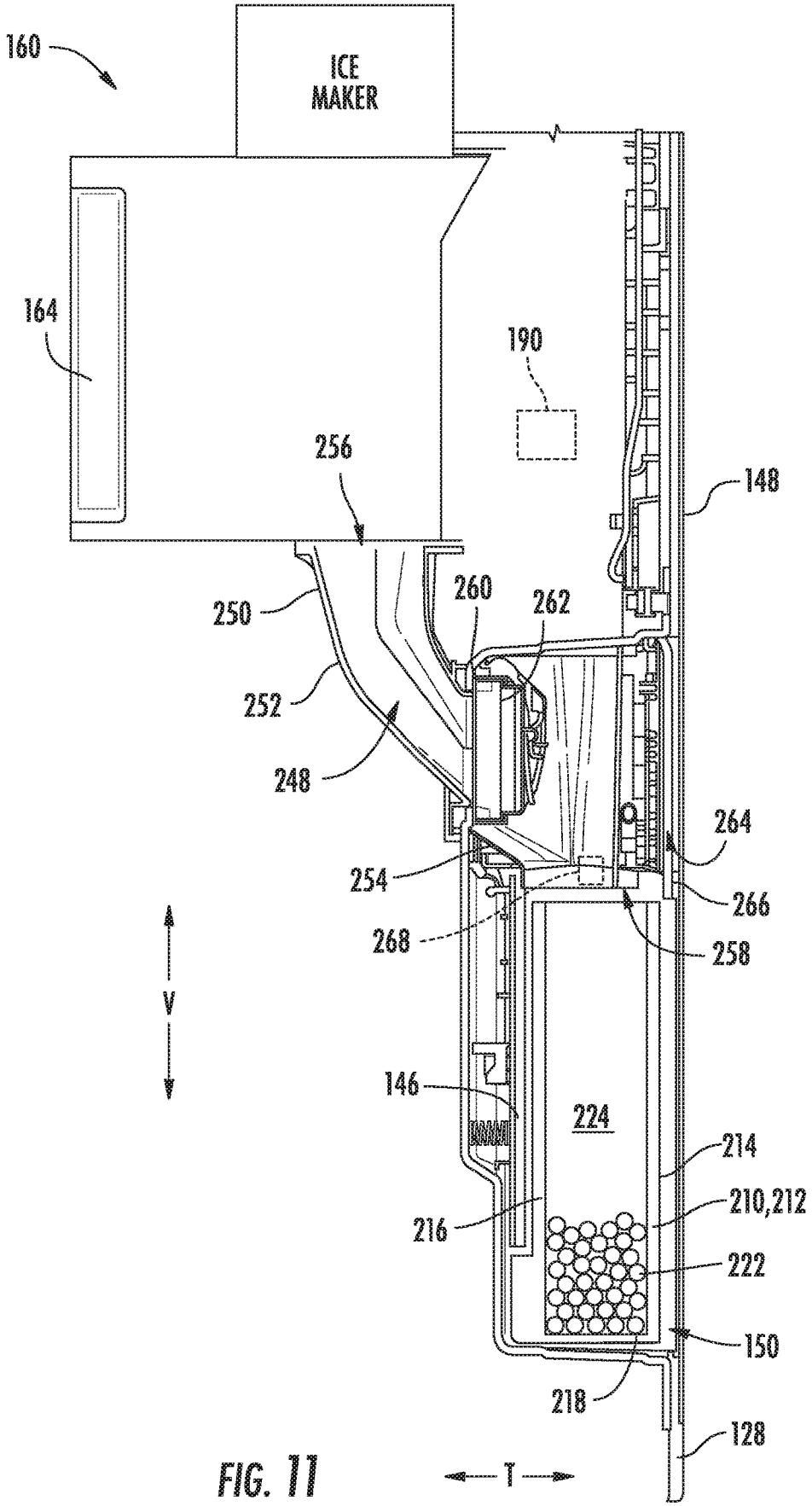
FIG. 11 provides a cross-sectional side view of an ice bin and dispensing assembly of a refrigerator appliance according to exemplary embodiments of the present disclosure.

Turning now to FIGS. 10 and 11, a plan view and cross-sectional side view are provided of exemplary embodiments of dispensing assembly 140, including an ice storage bin 210 mounted therein. As shown, dispensing assembly 140 defines an ice delivery passage 248. Generally, dispenser conduit 250 is positioned at least partially within one of refrigerator doors 128 and serves to guide ice into dispenser recess 150. Dispenser conduit 250 may extend from ice-making assembly 160 (e.g., from storage bin 164 or, alternatively, directly from an icemaker therein) to dispenser recess 150. In exemplary embodiments, dispenser conduit 250 includes a top piece or member 252 that is joined or connected to a bottom piece or member 254 (e.g., at joint 260). An inlet 256 is positioned at or adjacent ice-making assembly 160, while an outlet 258 is positioned below inlet 256 in the vertical direction V. It is understood that outlet 258 substantially forms or corresponds to discharging outlet 144 (FIG. 1). Together, the top member 252 and a bottom member 254 may define ice delivery passage 248 from inlet 256 to outlet 258.

In some embodiments, a duct door 262 is positioned within dispenser conduit 250 (e.g., at or adjacent joint 260 between top member 252 and bottom member 254). Duct door 262 is selectively adjustable (e.g., rotatable) between an open position and a closed position. In the closed position, duct door 262 is covers a portion of ice delivery passage 248 between dispenser recess 150 and freezer sub-compartment 162 (FIG. 2). For example, in the closed position, duct door 262 may span across an internal portion of dispenser conduit 250 (e.g., at joint 260). Thus, duct door 262 may block or hinder air flow between dispenser recess 150 and freezer sub-compartment 162 and reduce heat transfer between dispenser recess 150 and freezer sub-compartment 162. Conversely, in the open position, duct door 262 is not positioned between dispenser recess 150 and freezer sub-compartment 162. Thus, ice from ice-making assembly 160 may flow through ice delivery passage 248 to outlet 258 without impacting duct door 262. Duct door 262 may normally be in the closed position and may shift to the open position in response to receiving a fill input (e.g., initiated when a user operates actuator 146). Dispenser conduit 250 may be sized and shaped (e.g., with a recess) for permitting movement or rotation of duct door 262 between the open and closed positions within dispenser conduit 250.

In exemplary embodiments, a water delivery passage 264 is provided separate (e.g., in fluid isolation) from ice delivery passage 248. For instance, a water conduit 266 defining water delivery passage 264 may be positioned forward from dispenser conduit 250. Generally, water conduit 266 is disposed in selective fluid communication with a water source (not pictured), such as a municipal water supply (e.g., via one or more fluid tubes or ducts), to receive water therefrom. As shown, water conduit 266 and water delivery passage 264 are generally directed toward dispenser recess 150. Thus, during operation, water conduit 266 may direct water to a container within dispenser recess 150. In some embodiments, water conduit 266 and water delivery passage 264 are positioned forward from ice storage bin 210 (e.g., along the transverse direction T when ice storage bin 210 is mounted within dispenser recess 150). Advantageously, water may be directed to a separate container and not within storage cavity 224, even as ice storage bin 210 is positioned within dispenser recess 150 to receive ice from dispenser conduit 250.

In optional embodiments, one or more detection sensors 268 are provided within dispensing assembly 140. In some such embodiments, a detection sensor 268 is fixed on refrigerator door 128 (e.g., above dispenser recess 150). Detection sensor 268 may be operable to detect the presence of one or more objects within dispenser recess 150. For instance, detection sensor 268 may be operable to measure the height of ice 222 within storage cavity 224 (e.g., the distance between detection sensor 268 and the uppermost surface of ice 222 within storage cavity 224).

In exemplary embodiments, detection sensor 268 is any suitable device for detecting or measuring distance to an object. For example, detection sensor 268 may be an ultrasonic sensor, an infrared sensor, or a laser range sensor. Controller 190 may be operably coupled to detection sensor and can receive a signal, such as a voltage or a current, from detection sensor 268 that corresponds to the detected presence of or distance to ice 222 within storage cavity 224. According to the signal(s) from detection sensor 268, controller 190 may transmit one or more signals (e.g., to direct or control the position of duct door 262 within dispenser conduit 250).

Figure 12:
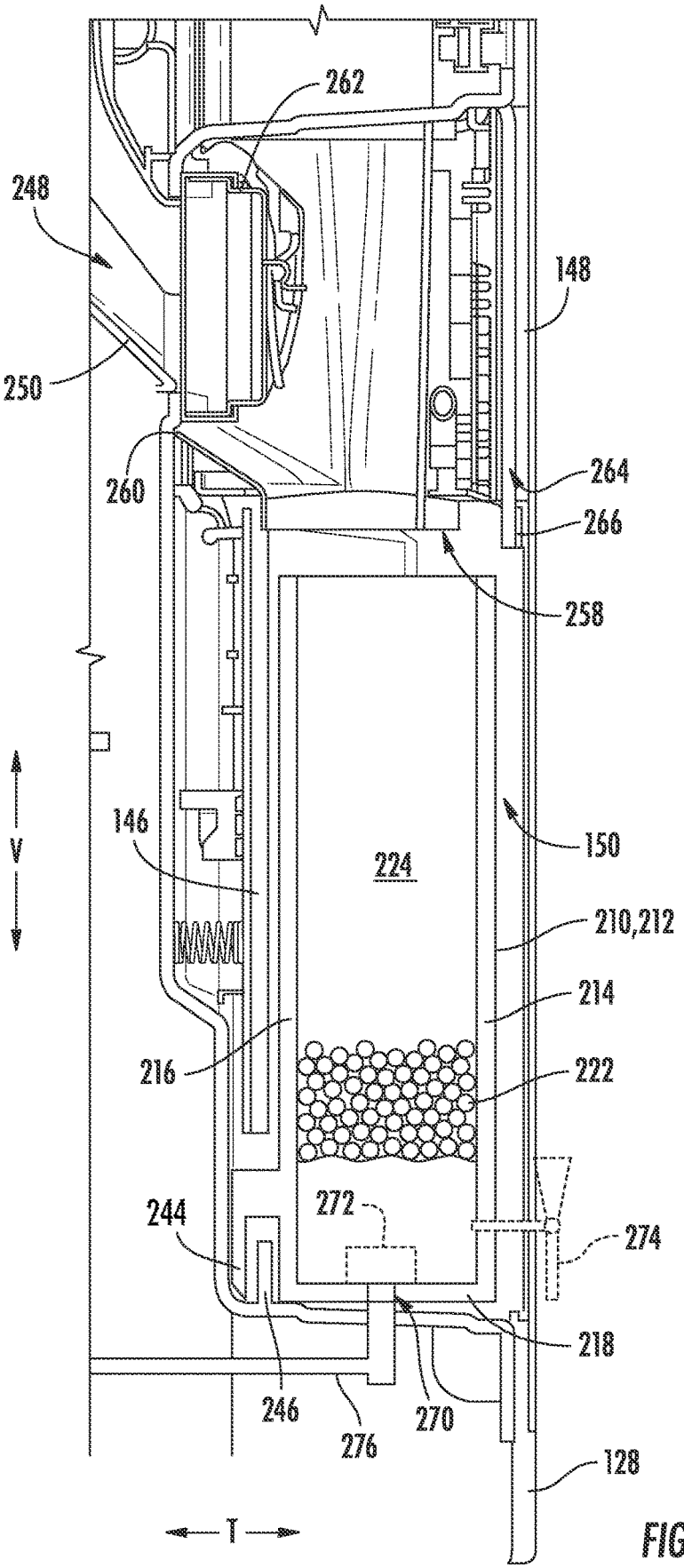
FIG. 12 provides a cross-sectional side view of an ice bin and dispensing assembly of a refrigerator appliance according to further exemplary embodiments of the present disclosure.
Figure 13:
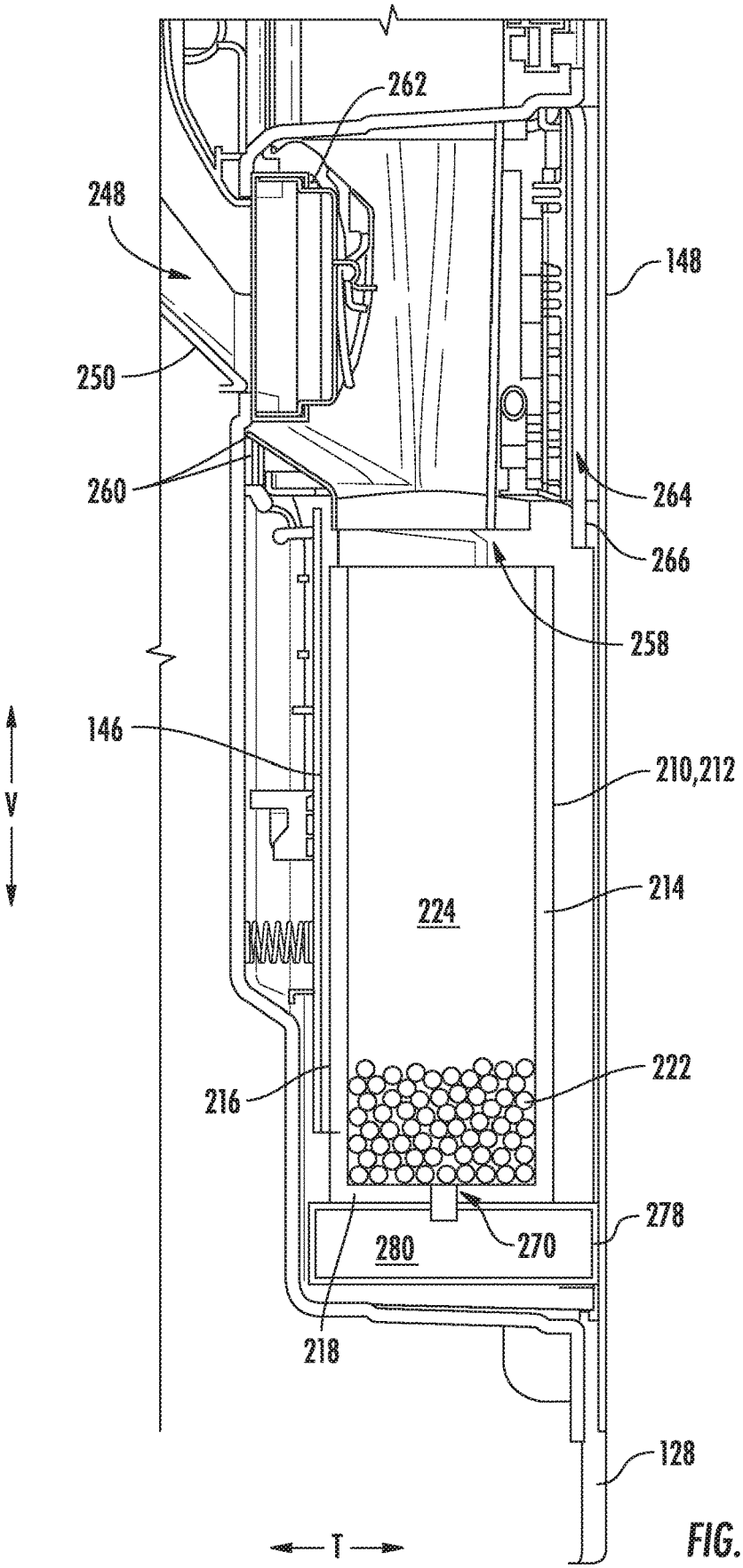
FIG. 13 provides a cross-sectional side view of an ice bin and dispensing assembly of a refrigerator appliance according to still further exemplary embodiments of the present disclosure.

Turning generally to FIGS. 12 and 13, cross-sectional side views are provided of further exemplary embodiments of dispensing assembly 140 in ice storage bin 210 having one or more features for managing water generated from melted ice within storage cavity 224.

As shown in FIG. 12, in certain embodiments, a drain aperture 270 is defined through base wall 218 (e.g., along the vertical direction V). Drain aperture 270 may be in fluid communication with storage cavity 224 such that melted water therein may escape bin body 212 through drain aperture 270. As understood, drain aperture 270 may be provided as a single void or, alternatively, as a plurality of perforations to permit water therethrough. Optionally, a check valve 272, as indicated in phantom lines, may further be provided on (e.g., mounted to) bin body 212. For instance, a check valve 272 may be mounted to base wall 218 and selectively cover or extend through drain aperture 270. When ice storage bin 210 is mounted within dispenser recess 150, check valve 272 may engage a corresponding or mating element that is mounted to dispensing assembly 140 below ice storage bin 210. The corresponding or mating element may then act to move a portion of check valve 272 away from drain aperture 270 such that water is permitted to flow therethrough.

Separate from or in addition to check valve 272, certain embodiments include a spigot valve 274, as further indicated in phantom lines. For instance, spigot valve 274 may be mounted to front sidewall 214 (e.g., proximal to base wall 218) and in fluid communication with storage cavity 224. As is understood, spigot valve 274 may include any suitable plunger or handle to selectively open spigot valve 274 and permit water to flow from storage cavity 224.

In additional or alternative embodiments, a fluid conduit 276 is mounted within the door in selective fluid communication with drain aperture 270 (e.g., to receive water therefrom). For instance, when ice storage bin 210 is mounted within dispenser recess 150, fluid conduit 276 may be vertically aligned with and below drain aperture 270 such that melted water is permitted to flow from storage cavity 224, through drain aperture 270, and to fluid conduit 276. As is understood, fluid conduit 276 may extend from the door to any suitable portion or flow path within refrigerator appliance (FIG. 1), such as to a water return line or evaporation pan 172 (FIG. 1).

Turning now to FIG. 13, further additional or alternative embodiments include a receiving tray 278 that defines a melt cavity 280 positioned or positionable below ice storage bin 210 to selectively receive water from drain aperture 270. As shown, when ice storage bin 210 is mounted within dispenser recess 150, receiving tray 278 and melt cavity 280 may be vertically aligned beneath drain aperture 270. As water accumulates within storage cavity 224, a portion of the water may flow through drain aperture 270 and into melt cavity 280. In optional embodiments, receiving tray 278 is slidably mounted within sensing assembly to selectively move along the transverse direction T into and out of the door 128. Thus, the user may selectively slide receiving tray 278 (e.g., along the transverse direction T) into and out of alignment with drain aperture 270. Moreover, once the melt cavity 280 is filled to or near capacity, a user may remove receiving tray 278, remove the water from receiving tray 278, and reinsert receiving tray 278 below drain aperture 270.

Returning generally to FIGS. 10 and 11, multiple exemplary embodiments of bin fill operations will be described. As noted above, controller 190 may be in operably coupled to (i.e., in operable communication with) dispensing assembly 140, such as at interface panel 148, actuator 146, detection sensors 268, or duct door 262. Moreover, controller 190 may be configured initiate one or more operations of refrigerator appliance 100 (FIG. 1). One of these operations may include a bin fill operation in which ice is directed through dispenser conduit 250 and, for example, to storage cavity 224. Thus, controller 190 may be configured to initiate a bin fill operation.

As an example, the bin fill operation may generally be prompted by a user engaging dispenser actuator 146. Specifically, the bin fill operation may include receiving a fill input from dispenser actuator 146. As described above, dispenser actuator 146 may transmit an input signal, which is received by controller 190, in response to a user engaging or depressing actuator 146. In some embodiments, dispenser actuator 146 is engaged through ice storage bin 210. In other words, as storage bin is moved rearward (e.g., along the transverse direction T) while it is mounted within dispenser recess 150. In response to receiving the fill input, controller 190 may direct ice to ice storage bin 210. For instance, duct door 262 may be moved to an open position or a motor within storage bin 164 may be activated to rotate or motivate ice through dispenser conduit 250. Optionally, directing ice by controller 190 may be directly linked to the engagement of dispenser actuator 146. After dispenser actuator 146 has been engaged and ice is directed to storage cavity 224, controller 190 may halt or stop directing ice in response to dispenser actuator 146 being released or otherwise no longer engaged.

As an additional or alternative example, the bin fill operation may correspond to a time-based prompt received at interface panel 148. Specifically, the bin fill operation may include receiving a fill input from interface panel 148. In some such embodiments, a user selects the bin fill operation via a button or selection at interface panel 148, which prompts transmission of the signal to controller 190. Optionally, the selected fill operation may correspond to a general level or volume of ice desired from dispensing assembly 140. In some such embodiments, the fill operation includes directing ice to ice storage bin 210 for a predetermined time period (e.g., in response to receiving the fill input). For instance, duct door 262 may be moved to an open position or a motor within storage bin 164 may be activated to rotate or motivate ice through dispenser conduit 250 for the duration of the predetermined time period. Upon expiration of the predetermined time period, controller 190 may halt or stop directing ice from dispenser conduit 250.

As a further additional or alternative example, the bin fill operation may correspond to a volume-based prompt received at interface panel 148. Specifically, the bin fill operation may include receiving a fill input from interface panel 148. In some such embodiments, a user selects the bin fill operation via a button or selection at interface panel 148, which prompts transmission of the input signal to controller 190. Optionally, the selected fill operation may correspond to a general level or volume of ice desired within ice storage bin 210. In some such embodiments, the fill operation may include receiving an ice level signal from one or more of detection sensors 268 (e.g., subsequent to receiving the fill input), as described above. In response to receiving the fill input, the bin fill operation includes directing ice to ice storage bin 210 (e.g., based on the ice level signal). For instance, duct door 262 may be moved to an open position or a motor within storage bin 164 may be activated to rotate or motivate ice through dispenser conduit 250 until a predetermined ice level is reached. As is understood, controller 190 may calculate the necessary ice volume required to reach predetermined ice level based on the first fill input. Alternatively, as further understood, controller 190 may receive multiple secondary ice level signals subsequent to the start of directing ice to storage cavity 224. Based on these secondary fill signals controller 190 may determine whether the predetermined ice level as yet been reached. Upon reaching the predetermined ice level, controller 190 may halt or stop directing ice from dispenser conduit 250.

It is noted that although several exemplary fill operations are described above, the present disclosure is not limited to these embodiments, and any suitable fill operation for providing ice within storage cavity 224 may be implemented.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a mutually-orthogonal vertical direction, lateral direction, and transverse direction, the refrigerator appliance comprising:

a cabinet defining a chilled chamber;

a door defining a dispenser recess on an exterior portion of the refrigerator appliance that is outside of the chilled chamber, the dispenser recess having a transverse opening extending vertically from a top recess end to a bottom recess end and laterally from a first recess side to a second recess side, the door being rotatably hinged to the cabinet to rotate between a closed position restricting access to the chilled chamber and an open position permitting access to the chilled chamber;

a dispensing assembly defining an ice delivery passage directed to the dispenser recess;

an ice-making assembly comprising an icemaker attached to the cabinet; and a removable ice storage bin comprising a bin body defining a storage cavity, the bin body being selectively mounted to the door within the dispenser recess at the exterior portion of the refrigerator appliance to receive ice from the dispensing assembly, the bin body extending vertically from the top recess end to the bottom recess end and laterally from the first recess side to the second recess side, wherein the dispensing assembly further comprises a dispenser actuator positioned within the dispenser recess rearward from the removable ice storage bin along the transverse direction, the dispenser actuator comprising a paddle, and wherein the bin body comprises a sidewall defining a paddle groove as a concave surface that is complementary to the paddle of the dispenser actuator to receive the paddle therein, the sidewall further defining a curved exterior surface as a negative of at least a portion of the dispenser recess such that the removable ice storage bin may be transversely aligned and supported on the dispenser recess.

2. The refrigerator appliance of claim 1, wherein the removable ice storage bin further defines a cavity outlet extending in fluid communication between the storage cavity and a front face of the bin body, and wherein a bin paddle is mounted to the bin body to selectively move between a release position permitting ice passage from the cavity outlet and a block position restricting ice passage from the storage cavity through the cavity outlet.

3. The refrigerator appliance of claim 1, wherein the dispensing assembly further comprises a water delivery passage directed toward the dispenser recess and positioned forward from the removable ice storage bin along the transverse direction.

4. The refrigerator appliance of claim 1, wherein the removable ice storage bin further defines a drain aperture at a base wall in fluid communication with the storage cavity.

5. The refrigerator appliance of claim 4, further comprising a fluid conduit mounted within the door in selective fluid communication with the drain aperture to receive water therefrom.

6. The refrigerator appliance of claim 4, further comprising a receiving tray slidably mounted below the removable ice storage bin in selective fluid communication with the drain aperture to receive water therefrom.

7. The refrigerator appliance of claim 1, further comprising a controller configured to initiate a bin fill operation, the bin fill operation comprising receiving a fill input from the dispenser actuator, and directing ice to the removable ice storage bin in response to receiving the fill input.

8. The refrigerator appliance of claim 1, further comprising a controller configured to initiate a bin fill operation, the bin fill operation comprising receiving a fill input from an interface panel spaced apart from the dispenser recess, and directing ice to the removable ice storage bin for a predetermined time period in response to receiving the fill input.

9. The refrigerator appliance of claim 1, further comprising a controller configured to initiate a bin fill operation, the bin fill operation comprising receiving a fill input from an interface panel spaced apart from the dispenser recess, receiving an ice-level signal from a detection sensor directed toward the removable ice storage bin within the dispenser recess, and directing ice to the removable ice storage bin based on the ice-level signal in response to receiving the fill input.

10. A refrigerator appliance defining a mutually-orthogonal vertical direction, lateral direction, and transverse direction, the refrigerator appliance comprising:

a cabinet defining a chilled chamber;

a door defining a dispenser recess on an exterior portion of the refrigerator appliance that is outside of the chilled chamber, the dispenser recess having a transverse opening extending vertically from a top recess end to a bottom recess end and laterally from a first recess side to a second recess side, the door being rotatably hinged to the cabinet to rotate between a closed position restricting access to the chilled chamber and an open position permitting access to the chilled chamber;

a dispensing assembly defining an ice delivery passage and a water delivery passage, the ice delivery passage and the water delivery passage being directed toward the dispenser recess;

an ice-making assembly comprising an icemaker attached to the cabinet; and a removable ice storage bin comprising a transparent bin body defining a storage cavity rearward from the water delivery passage along the transverse direction, the transparent bin body being selectively mounted to the door within the dispenser recess at the exterior portion of the refrigerator appliance to receive ice from the dispensing assembly, the transparent bin body extending vertically from the top recess end to the bottom recess end and laterally from the first recess side to the second recess side, wherein the dispensing assembly further comprises a dispenser actuator positioned within the dispenser recess rearward from the removable ice storage bin along the transverse direction, the dispenser actuator comprising a paddle, and wherein the bin body comprises a sidewall defining a paddle groove as a concave surface that is complementary to the paddle of the dispenser actuator to receive the paddle therein, the sidewall further defining a curved exterior surface as a negative of at least a portion of the dispenser recess such that the removable ice storage bin may be transversely aligned and supported on the dispenser recess.

11. The refrigerator appliance of claim 10, wherein the removable ice storage bin further defines a cavity outlet extending in fluid communication between the storage cavity and a front face of the transparent bin body, and wherein a bin paddle is mounted to the transparent bin body to selectively move between a release position permitting ice passage from the cavity outlet and a block position restricting ice passage from the storage cavity through the cavity outlet.

12. The refrigerator appliance of claim 10, wherein the removable ice storage bin further defines a drain aperture at a base wall in fluid communication with the storage cavity.

13. The refrigerator appliance of claim 12, further comprising a fluid conduit mounted within the door in selective fluid communication with the drain aperture to receive water therefrom.

14. The refrigerator appliance of claim 12, further comprising a receiving tray slidably mounted below the removable ice storage bin in selective fluid communication with the drain aperture to receive water therefrom.

15. The refrigerator appliance of claim 10, further comprising a controller configured to initiate a bin fill operation, the bin fill operation comprising receiving a fill input from the dispenser actuator, and directing ice to the removable ice storage bin in response to receiving the fill input.

16. The refrigerator appliance of claim 10, further comprising a controller configured to initiate a bin fill operation, the bin fill operation comprising receiving a fill input from an interface panel spaced apart from the dispenser recess, and directing ice to the removable ice storage bin for a predetermined time period in response to receiving the fill input.

17. The refrigerator appliance of claim 10, further comprising a controller configured to initiate a bin fill operation, the bin fill operation comprising receiving a fill input from an interface panel spaced apart from the dispenser recess, receiving an ice-level signal from a detection sensor directed toward the removable ice storage bin within the dispenser recess, and directing ice to the removable ice storage bin based on the ice-level signal in response to receiving the fill input.

18. A refrigerator appliance defining a mutually-orthogonal vertical direction, lateral direction, and transverse direction, the refrigerator appliance comprising:

a cabinet defining a chilled chamber;

a door defining a dispenser recess on an exterior portion of the refrigerator appliance that is outside of the chilled chamber, the dispenser recess having a transverse opening extending vertically from a top recess end to a bottom recess end and laterally from a first recess side to a second recess side, the door being rotatably hinged to the cabinet to rotate between a closed position restricting access to the chilled chamber and an open position permitting access to the chilled chamber;

a dispensing assembly defining an ice delivery passage directed to the dispenser recess;

an ice-making assembly comprising an icemaker attached to the cabinet; and a removable ice storage bin comprising a bin body defining a storage cavity, the bin body being selectively mounted to the door within the dispenser recess at the exterior portion of the refrigerator appliance to receive ice from the dispensing assembly, the bin body extending vertically from the top recess end to the bottom recess end and laterally from the first recess side to the second recess side, wherein the dispensing assembly further comprises a dispenser actuator positioned within the dispenser recess rearward from the ice storage bin along the transverse direction, wherein the bin body comprises a sidewall and a base wall below the sidewall, the sidewall defining a paddle groove as a generally concave surface that is complementary to the dispenser actuator to receive the dispenser actuator therein, the sidewall further defining a curved exterior surface as a negative of at least a portion of the dispenser recess such that the removable ice storage bin may be transversely aligned and supported on the dispenser recess, wherein the removable ice storage bin further defines a cavity outlet extending in fluid communication between the storage cavity and a front face of the bin body, and wherein a bin paddle is mounted to the sidewall opposite from the paddle groove to selectively move between a release position permitting ice passage from the cavity outlet and a block position restricting ice passage from the storage cavity through the cavity outlet.

19. The refrigerator appliance of claim 18, wherein the dispensing assembly further comprises a water delivery passage directed toward the dispenser recess and positioned forward from the removable ice storage bin along the transverse direction.

20. The refrigerator appliance of claim 18, wherein the removable ice storage bin further defines a drain aperture at a base wall in fluid communication with the storage cavity.

* * * * *